US010905183B2

(12) United States Patent
Tsukahara et al.

(10) Patent No.: US 10,905,183 B2
(45) Date of Patent: Feb. 2, 2021

(54) RESIN COMPOSITION FOR ARTIFICIAL HAIR AND MOLDED BODY OF SAME

(71) Applicant: DENKA COMPANY LIMITED, Tokyo (JP)

(72) Inventors: Megumi Tsukahara, Kamakura (JP); Atsushi Horihata, Kamakura (JP); Atsushi Takei, Kamakura (JP)

(73) Assignee: DENKA COMPANY LIMITED, Tokyo (JP)

( * ) Notice: Subject to any disclaimer, the term of this patent is extended or adjusted under 35 U.S.C. 154(b) by 96 days.

(21) Appl. No.: 16/088,799

(22) PCT Filed: Mar. 7, 2017

(86) PCT No.: PCT/JP2017/008943
§ 371 (c)(1),
(2) Date: Sep. 26, 2018

(87) PCT Pub. No.: WO2017/179340
PCT Pub. Date: Oct. 19, 2017

(65) Prior Publication Data

US 2019/0125020 A1 May 2, 2019

(30) Foreign Application Priority Data

Apr. 13, 2016 (JP) ..... 2016-080124

(51) Int. Cl.

| | |
|---|---|
| ***A41G 3/00*** | (2006.01) |
| ***D01F 6/62*** | (2006.01) |
| ***D01F 6/92*** | (2006.01) |
| ***D01F 1/07*** | (2006.01) |

(52) U.S. Cl.
CPC ..... *A41G 3/0083* (2013.01); *D01F 1/07* (2013.01); *D01F 6/62* (2013.01); *D01F 6/92* (2013.01)

(58) Field of Classification Search
CPC ... A41G 3/0083; C08L 67/02; C08L 2666/18; C09K 21/08; D01F 1/07; D01F 6/92; D01F 6/62; Y10T 428/2913
USPC ..... 524/411, 412, 469; 428/357, 364; 525/176, 177
See application file for complete search history.

(56) References Cited

U.S. PATENT DOCUMENTS

| | | | | |
|---|---|---|---|---|
| 3,953,394 | A * | 4/1976 | Fox | C08L 67/02 524/86 |
| 4,370,438 | A * | 1/1983 | DeGuia | C08K 3/34 524/412 |
| 2007/0021543 | A1* | 1/2007 | Masuda | A41G 3/0083 524/412 |
| 2008/0233395 | A1* | 9/2008 | Masuda | C09K 21/08 428/364 |
| 2011/0269878 | A1 | 11/2011 | Masuda et al. | |
| 2013/0133676 | A1 | 5/2013 | Masuda et al. | |

FOREIGN PATENT DOCUMENTS

| | | | |
|---|---|---|---|
| JP | 2004-156149 | A | 6/2004 |
| JP | 2006-144211 | A | 6/2006 |
| JP | 2007-126786 | A | 5/2007 |
| KR | 2003-0064622 | A | 8/2003 |
| WO | WO2007-049561 | * | 5/2007 |

OTHER PUBLICATIONS

May 16, 2017 International Search Report issued in International Patent Application No. PCT/JP2017/008943.

* cited by examiner

*Primary Examiner* — Camie S Thompson
(74) *Attorney, Agent, or Firm* — Oliff PLC

(57) ABSTRACT

A resin composition for flame retardant artificial hair which has favorable transparency and combability similar to those of human hair and exhibits excellent flame retardancy. A resin composition for flame retardant artificial hair is obtained by configuring a resin composition including 100 parts by mass of a polyester (A) and 5-40 parts by mass of a bromine-containing flame retardant (B) including at least one kind selected from poly(pentabromobenzyl acrylate), a brominated phenol resin, and polydibromophenylene oxide, wherein the melt viscosity of the polyester (A) is 80-300 Pa·s.

6 Claims, No Drawings

RESIN COMPOSITION FOR ARTIFICIAL HAIR AND MOLDED BODY OF SAME

TECHNICAL FIELD

The present invention pertains to a resin composition for artificial hair and a molded body of the same.

BACKGROUND ART

Patent document 1 discloses a vinyl chloride resin as a material constituting fibers for artificial hair. Vinyl chloride resin has excellent workability, low cost, and transparency, etc.

However, fibers for artificial hair having vinyl chloride resin as a material thereof has poor heat resistance to hair irons and the like, and when curling using hair irons etc. that normally have a temperature setting of at least 100° C., fusion, frizzing, etc. of the fibers may occur, resulting in fibers becoming damaged or broken.

Meanwhile, artificial hair fibers having a polyester resin as a material thereof have improved heat resistance to hair irons. However, since polyester is combustible, there is a danger of burns by contact with flames or molten resin, thus providing flame retardancy is desirable.

Patent document 2 discloses flame retardant polyester fibers comprising polyester and a resin composition that contains a bromine-containing flame retardant and an antimony compound. The flame retardancy of the polyester is solved by adding a bromine-containing flame retardant and an antimony compound to the polyester.

Fibers for artificial hair having polyester as a material thereof have heat resistance to hair irons, but due to the abovementioned combustibility thereof, from the perspective of the safety of a wearer, providing flame retardancy is desirable.

Adding a flame retardant is generally performed when trying to provide polyester with flame retardancy. As a flame retardant, bromine-based flame retardants, phosphor-based flame retardants, nitrogen-based flame retardants, and hydrated metal compounds, etc. are commercially available, but a combination of a bromine-based flame retardant and flame retardant auxiliary agent is deemed to provide the highest effects of flame retardancy.

However, polyester and a bromine-based flame retardant is not a compatible combination and therefore, when melted and kneaded, the distribution of the bromine-based flame retardant in a polyester resin is insufficient and there were problems in that transparency and combability are poor.

By limiting the average particle diameter and added amount of an antimony compound, transparency is solved to a certain extent, but compared to vinyl chloride fibers and nylon fibers, transparency was poor and insufficient for use as fibers for artificial hair. Further, by coating various kinds of silicone-based oils on fibers, combability is solved to some extent, but silicone-based oils are combustible and therefore, there was a problem in that flame retardancy decreases.

PATENT DOCUMENTS

Patent Document 1: Japanese Published Patent Publication No. 2004-156149

Patent Document 2: Japanese Published Patent Publication No. 2006-144211

SUMMARY OF THE INVENTION

In view of such circumstances, the present invention provides: a resin composition for flame retardant artificial hair which has favorable transparency and combability similar to those of human hair and exhibits excellent flame retardancy; and a molded body of the same.

The present invention employs the following means in order to solve the abovementioned problem.

(1) A resin composition for flame retardant artificial hair, said composition being characterized by comprising 100 parts by mass of a polyester (A) and 5-40 parts by mass of at least one kind of bromine-containing flame retardant (B) selected from poly(pentabromobenzyl acrylate), a brominated phenol resin, and polydibromophenylene oxide and in that the melt viscosity of the polyester (A) is 80-300 Pa·s.

(2) The resin composition for flame retardant artificial hair according to (1) characterized by further containing 0.1-15 parts by mass of at least one kind of bromine-containing flame retardant (C) selected from brominated polystyrene, ethylene bis-tetrabromophthalimide, bis(pentabromophenyl)ethane, a brominated epoxy resin and a brominated phenoxy resin.

(3) The resin composition for flame retardant artificial hair according to (1) or (2) characterized by further containing a flame retardant auxiliary agent (D) having an average particle diameter of 0.5-1.5 μm.

(4) The resin composition for flame retardant artificial hair according to any of (1) to (3) characterized in that the polyester (A) comprises polyethylene terephthalate and polybutylene terephthalate, and in that the mass ratio of the polyethylene terephthalate to the polybutylene terephthalate is 40/60-98/2.

(5) The resin composition for flame retardant artificial hair according to any of (1) to (3) characterized in that the polyester (A) comprises polyethylene terephthalate and polytrimethylene terephthalate, and in that the mass ratio of the polyethylene terephthalate to the polytrimethylene terephthalate is 40/60-98/2.

(6) A fibrous molded body comprising the resin composition for flame retardant artificial hair according to any of (1) to (5).

(7) A wig comprising the fibrous molded body according to (6).

DESCRIPTION OF EMBODIMENTS

A resin composition for flame retardant artificial hair according to one embodiment of the present invention is characterized by comprising 100 parts by mass of a polyester (A) and 5-40 parts by mass of a bromine-containing flame retardant (B) comprising at least one kind selected from poly(pentabromobenzyl acrylate), a brominated phenol resin, and a polydibromophenylene oxide agent, and in that the melt viscosity of the polyester (A) is 80-300 Pa·s. [0012] (Polyester (A))

Polyester (A) is not particularly limited and, in addition to a polyester resin obtained from an aromatic or aliphatic multi-functional carboxylic acid and a multi-functional glycol, comprises a hydroxycarboxylic acid-based polyester resin. As specific examples of the former, polyethylene terephthalate, polybutylene terephthalate, polyethylene naphthalate, polybutylene naphthalate, polyethylene adipate, polybutylene adipate and other copolymers thereof are provided.

In an embodiment, a copolymerized polyester containing polyethylene terephthalate, polybutylene terephthalate, polytrimethylene terephthalate, and/or the same as a main constituent (main constituent means containing at least 80 mol % of a polyalkylene terephthalate) and a small amount of a copolymerization component may be used as the polyester (A), but, from the perspective of texture of the fibers, easy availability, and cost, polyethylene terephthalate, polytrimethylene terephthalate, and polybutylene terephthalate are particularly preferable.

In one embodiment of the present invention, the polyester (A) is a resin in which polyethylene terephthalate and polybutylene terephthalate or polytrimethylene terephthalate are mixed and has a favorable texture more similar to that of human hair.

In an embodiment, the mass ratio of polyethylene terephthalate to polybutylene terephthalate or the mass ratio of polyethylene terephthalate to polytrimethylene terephthalate is preferably 40/60-98/2 and more preferably 65/35-96/4. If the mass ratio of polyethylene terephthalate is 40/60 or higher there is a tendency for at least a certain level of heat resistance to be obtained and by setting at 98/2 or lower, there is a tendency for an effect that improves the texture to be obtained.

Examples given as the copolymerization component are: a multivalent carboxylic acid such as isophthalic acid, orthophthalic acid, naphthalene dicarboxylic acid, paraphenylene dicarboxylic acid, trimellitic acid, pyromellitic acid, succinic acid, glutaric acid, adipic acid, suberic acid, azelaic acid, sebacic acid, dodecanedioic acid, etc. and derivatives thereof; a dicarboxylic acid comprising a sulfonate such as 5-sodium sulfoisophthalic acid, 5-sodium sulfoisophthalic acid dihydroxyethyl, etc. and derivatives thereof; and 1,2-propandiol, 1,3-propanediol, 1,4-butandiol, 1,6-hexanediol, neopentylglycol, 1,4-cyclohexanedimethanol, diethylenegycol, polyethyleneglycol, trimethylolpropane, pentaerythritol, 4-hydroxybenzoic acid, ε-caprolactone, etc.

Preparing the copolymerized polyester by including a small amount of a copolymerization component in a polymer of terephthalic acid and/or a derivative thereof (for example, methyl terephthalate) as a main constituent and an alkylene glycol and causing a reaction therebetween is normally preferred from the perspectives of safety and ease of operability, but the copolymerized polyester may also be prepared by further induding a small amount of a monomer or olygomer component, which serves as a copolymerization component, in a mixture of terephthalalic acid and/or a derivative thereof (for example, methyl terephthalate) as a main constituent and an alkylene glycol, and polymerizing the obtained product.

In an embodiment, the polyester (A) is included in at least 50 mass %, at least 60 mass %, or at least 80 mass % with respect to the resin composition.

The melt viscosity of the polyester (A) is 80-300 Pa·s, preferably 100-250 Pa·s, and more preferably 120-170 Pa·s. If the melt viscosity is 80 Pa·s or higher, there is a tendency for sufficient shear to be applied, the distribution of the bromine-containing flame retardant to be favorable, and for the combability to also be favorable. If the melt viscosity is 300 Pa·s or lower, the viscosity difference with the bromine-containing flame retardant becomes smaller and due thereto, there is a tendency for the distribution of the bromine-containing flame retardant to be favorable and for the combability to also be favorable.

In the present embodiment, the melt viscosity is a value measured under conditions of a sample amount of 20 cc, a set temperature of 285° C., a piston speed of 200 mm/min, a capillary length of 20 mm, and a capillary diameter of 1 mm, for pellets dehumidification-dried so that the moisture absorption rate thereof is 100 ppm or less. The measuring device used was a Capilograph 1D manufactured by Toyo Seiki Seisaku-sho, Ltd.

(Bromine-Containing Flame Retardant (B))

Poly(pentabromobenzyl acrylate), a brominated phenol resin and polydibromophenylene oxide are raised as the bromine-containing flame retardant (B). These may be employed using one kind, or two or more kinds may be employed in combination. By using the bromine-containing flame retardant (B), it is possible to address the problem of conventional fibers for flame retardant artificial hair, namely improving the transparency and combability thereof.

With respect to 100 parts by mass of the polyester (A), the blend amount of the bromine-containing flame retardant (B) is 5-40 parts by mass, preferably 10-30 parts by mass, and more preferably 15-25 parts by mass. If the blend amount of the bromine-containing flame retardant (B) is 5 parts by mass or more, flame retardancy is obtained and when 40 parts by mass or less, texture does not become poor.

(Bromine-Containing Flame Retardant (C))

The resin composition for flame retardant artificial hair according to the present embodiment may include a bromine-containing flame retardant (C). Brominated polystyrene, ethylene bis-tetrabromophthalimide, bis(pentabromophenyl)ethane, a brominated epoxy resin and a brominated phenoxy resin are raised as the bromine-containing flame retardant (C). These may be employed using one kind, or two or more kinds may be employed in combination. By blending the bromine-containing flame retardant (C), it is possible to provide an appearance closer resembling human hair having a low sheen.

In an embodiment, the blend amount of the bromine-containing flame retardant (C) with respect to 100 parts by mass of the polyester (A) is 0.1-15 parts by mass, preferably 0.3-5.0 parts by mass, and more preferably 0.5-3.0 parts by mass. If the blend amount of the bromine-containing flame retardant (C) is 0.1 parts by mass or more, an effect providing a low sheen is obtained, and when 15 parts by mass or less, transparency and combability do not readily become poor.

(Flame Retardant Auxiliary Agent (D))

The resin composition for flame retardant artificial hair according to the present embodiment may include a flame retardant auxiliary agent (D). As the flame retardant auxiliary agent (D), antimony trioxide, antimony tetroxide, antimony pentoxide, sodium antimonic acid, zinc borate, and zinc stannate are preferred, and from the perspective of flame retardancy and transparency, antimony trioxide and sodium antimonic acid are more preferred. These may be employed using one kind, or two or more kinds may be employed in combination. By blending the flame retardant auxiliary agent (D), it is possible to further improve flame retardancy.

In an embodiment, the average particle diameter of the flame retardant auxiliary agent (D) is 0.5-3.5 μm, preferably 0.6-1.8 μm, and more preferably 0.7-1.5 μm. If the average particle diameter is 0.5 μm or more, aggregation does not readily occur, uniform distribution is possible, and therefore non-uniformity of flame retardancy does not readily occur. If the average particle diameter is 3.5 μm or less, thread breakage originating therefrom does not readily occur.

In an embodiment, the blend amount of the flame retardant auxiliary agent (D) with respect to 100 parts by mass of the polyester (A) is 0.1-10 parts by mass, preferably 0.3-5 parts by mass, and more preferably 0.5-3 parts by mass. If the blend amount of the flame retardant auxiliary agent is 0.1 parts by mass or more, an effect of flame retardancy improvement is obtained and when 10 parts by mass or less, transparency does not readily become poor.

The average particle diameter of the flame retardant auxiliary agent (D) in an embodiment is a value, measured by a laser diffraction particle size distribution measurement method, of a suspension produced by: adding the flame retardant auxiliary agent dropwise and mixing well in 100 ml of a dispersant solution produced by adding 0.05 wt % of a liquid detergent to distilled water; further adding 40 ml of distilled water; and then irradiating for two minutes with an ultrasonic generator having a power of 160 W. The measurement device used was Microtrac MT3000 EXII manufactured by Nikkiso Co., Ltd.

In the resin composition for artificial hair used in the present embodiment, it is possible to include an additive according to needs, for example, a heat resistance agent, a light stabilizer, a fluorescence agent, an antioxidant, an antistatic agent, a pigment, a dye, a plasticizer, a lubricant, etc. By including a coloring agent such as a pigment, a dye, or the like, it is possible to obtain a pre-colored fiber (a so-called spun-dyed fiber).

The resin composition for artificial hair of the present embodiment can be used in the production of artificial hair such as wigs, hairpieces, and false hair such as false eyelashes and false beards.

(Production Method for a Resin Composition for Artificial Hair and a Fibrous Molded Body Thereof)

One example of a production process for a resin composition for flame retardant artificial hair and a fibrous molded body thereof according to one embodiment is explained below.

The resin composition according to one embodiment of the present invention can be produced, for example, by dry-blending the polyester (A) and the bromine-containing flame retardant (B), and then melt kneading using various conventional kneading machines. A single-screw extruder, twin-screw extruder, roll, Banbury mixer, kneader, etc. are given as examples of the kneading machine. Of these, a twin-screw extruder is preferred in terms of adjustment of the kneading degree and convenience of operation. The fiber for artificial hair can be produced by melt spinning by a normal melt spinning method under appropriate temperature conditions for a type of polyester.

When polyethylene terephthalate is used as the polyester and poly(pentabromobenzyl acylate) is used as the bromine-containing flame retardant in a ratio of 100 parts by mass/20 parts by mass, un-drawn yarns are obtained by melt spinning with temperatures of melt spinning devices such as an extruder, a spinneret, and, as needed, a gear pump, etc., at 260-290° C., cooling in a water tank filled with cooling water, and adjusting the take-off rate while controlling the size of the yarn. The temperature of the melt spinning device can be adjusted, as appropriate, according to the intrinsic viscosity of the polyester and the mass ratio of the polyester and the bromine-containing flame retardant. Further, regardless of cooling by a water tank, spinning by cooling with cool air is also possible. The temperature of the cooling water tank, the temperature of the cool air, cooling time, and take-off rate can be adjusted, as appropriate, according to the discharge amount and the number of holes in the spinneret.

When melt spinning, it is possible to use a spinning nozzle having a special shaped nozzle hole, not only a simple round shape, and to make the cross-sectional shape of fibers for artificial hair variant shapes such as cocoon-shaped, Y-shaped, H-shaped, X-shaped, petal-shaped, etc.

The obtained un-drawn yarns undergo a drawing treatment to improve the tensile strength of the fibers. The drawing treatment may be performed by a method of either: a two-step process in which the un-drawn yarn is once wound up on a bobbin and then drawn in a separate step from the melt-spinning step; or a direct spinning and drawing process in which the un-drawn yarn is drawn continuously from the melt spinning step without being wound up on a bobbin. Further, the drawing treatment can be performed by a one-stage drawing method for drawing at one time to a prescribed draw ratio or by a multistage drawing method for drawing to a prescribed draw ratio by drawing two or more times. As a heating means in hot drawing, a heating roller, heat plate, steam jet apparatus, hot water tank, etc. can be used and these can also be used, as appropriate, in combination.

The fiber size of the fibrous molded body of the resin composition for artificial hair according to the present embodiment is preferably 10-150 dtex, more preferably 30-150 dtex, and even more preferably 35-120 dtex.

EXAMPLES

Next, the examples of the resin composition for artificial hair of the present invention and a molded body of the same will be described in detail by comparing with comparative examples and using tables. However, the present invention is not limited to these examples.

The raw materials used in the examples, etc. are as described below.

<Polyester (A)>

Polyethylene terephthalate (manufactured by Denka Company Ltd., melt viscosity 65 Pa·s)

Polyethylene terephthalate (manufactured by Mitsui Chemicals, Inc., J125S, melt viscosity 145 Pa·s)

Polyethylene terephthalate (manufactured by Denka Company Ltd., melt viscosity 280 Pa·s)

Polyethylene terephthalate (manufactured by Mitsui Chemicals, Inc., J055, melt viscosity 450 Pa·s)

Polybutylene terephthalate (manufactured by DuPont, S600F20, melt viscosity 118 Pa·s)

Polytrimethylene terephthalate (manufactured by DuPont, Sorona EP3301NC010, melt viscosity 132 Pa·s)

<Bromine-Containing Flame Retardant (B)>

Poly(pentabromobenzyl acrylate) (manufactured by ICL JAPAN, FR-1025)

Brominated phenol resin (manufactured by Chemtura Japan, Emerald 1000)

Polydibromophenylene oxide (manufactured by DKS Co., Ltd., Pyroguard SR-460B)

<Bromine-Containing Flame Retardant (C)>

Brominated polystyrene (manufactured by Manac Inc., PS1200)

Ethylenebistetrabromophthalimide (manufactured by UNIBROM, EcoFlame B-951)

Bis(pentabromophenyl)ethane (manufactured by Albemarle Japan, SAYTEX 8010)

Brominated epoxy resin (manufactured by SakamotoYakuhin Kogyo, SR-T20000)

Brominated phenoxy resin (manufactured by Nippon Steel and Sumitomo Chemical, YPB-43C)

<Flame Retardant Auxiliary Agent (D)>

Antimony trioxide (manufactured by Nihon Seiko, PATOX-KF, average particle diameter 0.8 μm)

Antimony trioxide (manufactured by Nihon Seiko, PATOX-K, average particle diameter 1.2 μm)

Antimony trioxide (manufactured by Nihon Seiko, PATOX-P, average particle diameter 3.0 μm)

Sodium antimonic acid (manufactured by Nihon Seiko, SA-A, average particle diameter 2.0 μm)

Example 1

100 parts by mass of polyethylene terephthalate (manufactured by Mitsui Chemicals, Inc., J125S, melt viscosity 145 Pa·s), which is the polyester (A), dried so as to have a moisture absorption ratio of 100 ppm or less, was blended with 7 parts by mass of poly(pentabromobenzyl acrylate) (manufactured by ICL JAPAN, FR-1025) which is the bromine-containing flame retardant (B), and then kneaded using a 30 mm diameter twin extruder to obtain raw material pellets for spinning.

After being dried so as to have a water absorption rate of 100 ppm or less, the raw material pellets were melt spun at 270° C. using a ϕ40 mm single-screw melt spinning machine and, while cooling molten resin emitted from a die provided with holes each having a diameter of 0.5 mm by passing through a water tank of approximately 30° C., discharge amount and winding rate were adjusted and un-drawn yarns of a set size were produced.

The obtained un-drawn yarns were drawn at 85° C. and then annealed at 150° C. to obtain fibers of a prescribed size for artificial hair. Drawing and annealing were performed with a draw ratio of three times and a relaxation rate during annealing of 3%. The relaxation rate during annealing is a value calculated by (rotation speed of winding roller during annealing)/(rotation speed of feed roller during annealing).

The flame retardancy, transparency, texture, combability, and sheen of the obtained fibrous molded body of the resin composition for artificial hair were evaluated according to the evaluation methods and criteria described below.

Examples 2-24

With the exception of setting the blends shown in Table 1, fibrous molded bodies of the resin composition for artificial hair according to Examples 2-24 were prepared in the same manner as Example 1 and evaluated.

Comparative Example 1

With the exception of using polyethylene terephthalate (manufactured by Denka Company Ltd., melt viscosity 65 Pa·s) as the polyester (A), a fibrous molded body of the resin composition for artificial hair was produced in the same manner as Example 2. As a result thereof, combability deteriorated. This is thought to be due to insufficient shear being applied, since the melt viscosity of the polyester (A) is low, and the distribution of the bromine-containing flame retardant becoming poor.

Comparative Example 2

With the exception of using polyethylene terephthalate (manufactured by Mitsui Chemicals, Inc., J055, melt viscosity 450 Pa·s) as the polyester (A), a fibrous molded body of the resin composition for artificial hair was produced in the same manner as Example 2. As a result thereof, combability deteriorated. This is thought to be due to the difference in viscosity with the poly(pentabromobenzyl acrylate) becoming large, since the melt viscosity of the polyester (A) is high, and the distribution of the poly (pentabromobenzyl acrylate) becoming poor.

Comparative Example 3

With the exception of the blend amount of the poly (pentabromobenzyl acrylate) (manufactured by ICL JAPAN, FR-1025) being set to 3 parts by mass, a fibrous molded body of the resin composition for artificial hair was produced in the same manner as Example 1. As a result thereof, flame retardancy was not obtained.

Comparative Example 4

With the exception of the blend amount of the poly (pentabromobenzyl acrylate) (manufactured by ICL JAPAN, FR-1025) being set to 45 parts by mass, a fibrous molded body of the resin composition for artificial hair was produced in the same manner as Example 1. As a result thereof, texture deteriorated.

Comparative Example 5

With the exception of not blending the bromine-containing flame retardant (B) and setting the blend amount of the brominated polystyrene (manufactured by Manac Inc., PS1200) to 20 parts by mass, a fibrous molded body of the resin composition for artificial hair was produced in the same manner as Example 1. As a result thereof, transparency and combability deteriorated.

Comparative Example 6

With the exception of not blending the bromine-containing flame retardant (B) and setting the blend amount of the brominated epoxy resin (manufactured by SakamotoYakuhin Kogyo, SR-T20000), to 20 parts by mass, a fibrous molded body of the resin composition for artificial hair was produced in the same manner as Example 1. As a result thereof, transparency and combability deteriorated.

The evaluation results are shown in Tables 1-4.

TABLE 1

| | | | | Example 1 | Example 2 | Example 3 | Example 4 | Example 5 | Example 6 | Comparative Example 1 | Comparative Example 2 | Comparative Example 3 | Comparative Example 4 | Comparative Example 5 | Comparative Example 6 |
|---|---|---|---|---|---|---|---|---|---|---|---|---|---|---|---|
| Blend, etc. | Polyester (A) | Viscosity (Pa · s) | | 145 | 145 | 145 | 145 | 145 | 280 | 65 | 450 | 145 | 145 | 145 | 145 |
| | | Polyethylene terephthalate | Melt viscosity 65 Pa · s (parts by mass) | — | — | — | — | — | — | 100 | — | — | — | — | — |
| | | | Melt viscosity 145 Pa · s (parts by mass) | 100 | 100 | 100 | 100 | 100 | — | — | — | 100 | 100 | 100 | 100 |
| | | | Melt viscosity 280 Pa · s (parts by mass) | — | — | — | — | — | 100 | — | — | — | — | — | — |
| | | | Melt viscosity 450 Pa · s (parts by mass) | — | — | — | — | — | — | — | 100 | — | — | — | — |
| | | Polybutylene terephthalate | Melt viscosity 118 Pa · s (parts by mass) | — | — | — | — | — | — | — | — | — | — | — | — |
| | | Polytrimethylene terephthalate | Melt viscosity 132 Pa · s (parts by mass) | — | — | — | — | — | — | — | — | — | — | — | — |
| | Bromine-containing flame retardant (B) (parts by mass) | Poly(pentabromobenzyl acrylate) | | 7 | 20 | 35 | — | — | 20 | 20 | 20 | 3 | 45 | — | — |
| | | Brominated phenol resin | | — | — | — | 20 | — | — | — | — | — | — | — | — |
| | | Polydibromophenylene oxide | | — | — | — | — | 20 | — | — | — | — | — | — | — |
| | Bromine-containing flame retardant (C) (parts by mass) | Brominated polystyrene | | — | — | — | — | — | — | — | — | — | — | 20 | — |
| | | Ethylene bistetrabromophthalimide | | — | — | — | — | — | — | — | — | — | — | — | — |
| | | Bis(pentabromophenyl)ethane | | — | — | — | — | — | — | — | — | — | — | — | — |
| | | Brominated epoxy resin | | — | — | — | — | — | — | — | — | — | — | — | 20 |
| | | Brominated phenoxy resin | | — | — | — | — | — | — | — | — | — | — | — | — |
| | Flame retardant auxiliary agent (D) (parts by mass) | Antimony trioxide | Average particle diameter 0.8 μm | — | — | — | — | — | — | — | — | — | — | — | — |
| | | | Average particle diameter 1.2 μm | — | — | — | — | — | — | — | — | — | — | — | — |
| | | | Average particle diameter 3.0 μm | — | — | — | — | — | — | — | — | — | — | — | — |
| | | Sodium antimonic acid | Average particle diameter 2.0 μm | — | — | — | — | — | — | — | — | — | — | — | — |
| Evaluation | Flame retardancy | | | ○ | ○ | ○ | ○ | ○ | ○ | ○ | ○ | X | ○ | ○ | ○ |
| | Transparency | | | ◎ | ◎ | ◎ | ◎ | ◎ | ◎ | ○ | ○ | ◎ | ◎ | X | X |
| | Texture | | | ○ | ○ | ○ | ○ | ○ | ○ | ○ | ○ | ○ | X | ○ | ○ |
| | Combability | | | ○ | ○ | ○ | ○ | ○ | ○ | X | X | ○ | ○ | X | X |
| | Sheen | | | ○ | ○ | ○ | ○ | ○ | ○ | ○ | ○ | ○ | ○ | ○ | ○ |

TABLE 2

| | | | | Example 7 | Example 8 | Example 9 | Example 10 | Example 11 | Example 12 |
|---|---|---|---|---|---|---|---|---|---|
| Blend, etc | Polyester (A) | Viscosity (Pa · s) | | 145 | 145 | 145 | 145 | 145 | 145 |
| | | Polyethylene terephthalate | Melt viscosity 65 Pa · s (parts by mass) | — | — | — | — | — | — |
| | | | Melt viscosity 145 Pa · s (parts by mass) | 100 | 100 | 100 | 100 | 100 | 100 |
| | | | Melt viscosity 280 Pa · s (parts by mass) | — | — | — | — | — | — |
| | | | Melt viscosity 450 Pa · s (parts by mass) | — | — | — | — | — | — |
| | | Polybutylene terephthalate | Melt viscosity 118 Pa · s (parts by mass) | — | — | — | — | — | — |
| | | Polytrimethylene terephthalate | Melt viscosity 132 Pa · s (parts by mass) | — | — | — | — | — | — |
| | Bromine-containing flame retardant (B) (parts by mass) | Poly(pentabromobenzyl acrylate) | | 20 | 20 | 20 | 20 | 20 | — |
| | | Brominated phenol resin | | — | — | — | — | — | — |
| | | Polydibromophenylene oxide | | — | — | — | — | — | 20 |
| | Bromine-containing flame retardant (C) (parts by mass) | Brominated polystyrene | | 2 | — | — | — | — | 2 |
| | | Ethylene bistetrabromophthalimide | | — | 2 | — | — | — | — |
| | | Bis(pentabromophenyl)ethane | | — | — | 2 | — | — | — |
| | | Brominated epoxy resin | | — | — | — | 2 | — | — |
| | | Brominated phenoxy resin | | — | — | — | — | 2 | — |
| | Flame retardant auxiliary agent (D) (parts by mass) | Antimony trioxide | Average particle diameter 0.8 μm | — | — | — | — | — | — |
| | | | Average particle diameter 1.2 μm | — | — | — | — | — | — |
| | | | Average particle diameter 3.0 μm | — | — | — | — | — | — |
| | | Sodium antimonic acid | Average particle diameter 2.0 μm | — | — | — | — | — | — |
| Evaluation | Flame retardancy | | | ○ | ○ | ○ | ○ | ○ | ○ |
| | Transparency | | | ◎ | ◎ | ◎ | ◎ | ◎ | ◎ |
| | Texture | | | ○ | ○ | ○ | ○ | ○ | ○ |
| | Combability | | | ○ | ○ | ○ | ○ | ○ | ○ |
| | Sheen | | | ◎ | ◎ | ◎ | ◎ | ◎ | ◎ |

TABLE 3

| | | | | Example 13 | Example 14 | Example 15 | Example 16 | Example 17 | Example 18 |
|---|---|---|---|---|---|---|---|---|---|
| Blend, etc. | Polyester (A) | Viscosity (Pa · s) | | 145 | 145 | 145 | 145 | 145 | 145 |
| | | Polyethylene terephthalate | Melt viscosity 65 Pa · s (parts by mass) | — | — | — | — | — | — |
| | | | Melt viscosity 145 Pa · s (parts by mass) | 100 | 100 | 100 | 100 | 100 | 100 |
| | | | Melt viscosity 280 Pa · s (parts by mass) | — | — | — | — | — | — |
| | | | Melt viscosity 450 Pa · s (parts by mass) | — | — | — | — | — | — |
| | | Polybutylene terephthalate | Melt viscosity 118 Pa · s (parts by mass) | — | — | — | — | — | — |
| | | Polytrimethylene terephthalate | Melt viscosity 132 Pa · s (parts by mass) | — | — | — | — | — | — |

TABLE 3-continued

| | | | | Example 13 | Example 14 | Example 15 | Example 16 | Example 17 | Example 18 |
|---|---|---|---|---|---|---|---|---|---|
| | Bromine-containing flame retardant (B) (parts by mass) | Poly(pentabromobenzyl acrylate) | | 20 | 20 | 20 | 20 | 20 | — |
| | | Brominated phenol resin | | — | — | — | — | — | — |
| | | Polydibromophenylene oxide | | — | — | — | — | — | 20 |
| | Bromine-containing flame retardant (C) (parts by mass) | Brominated polystyrene | | — | 2 | — | — | — | — |
| | | Ethylene bistetrabromophthalimide | | — | — | — | — | — | — |
| | | Bis(pentabromophenyl)ethane | | — | — | — | — | — | — |
| | | Brominated epoxy resin | | — | — | — | — | — | 2 |
| | | Brominated phenoxy resin | | — | — | — | — | — | — |
| | Flame retardant auxiliary agent (D) (parts by mass) | Antimony trioxide | Average particle diameter 0.8 μm | 1 | 1 | — | — | — | 1 |
| | | | Average particle diameter 1.2 μm | — | — | 1 | — | — | — |
| | | | Average particle diameter 3.0 μm | — | — | — | 1 | — | — |
| | | Sodium antimonic acid | Average particle diameter 2.0 μm | — | — | — | — | 1 | — |
| Evaluation | Flame retardancy | | | ◎ | ◎ | ◎ | ◎ | ◎ | ◎ |
| | Transparency | | | ◎ | ◎ | ◎ | ○ | ○ | ◎ |
| | Texture | | | ○ | ○ | ○ | ○ | ○ | ○ |
| | Combability | | | ◎ | ◎ | ◎ | ◎ | ◎ | ◎ |
| | Sheen | | | ○ | ◎ | ○ | ○ | ○ | ◎ |

TABLE 4

| | | | | Example 19 | Example 20 | Example 21 | Example 22 | Example 23 | Example 24 |
|---|---|---|---|---|---|---|---|---|---|
| Blend, etc. | Polyester (A) | Viscosity (Pa · s) | | 144 | 144 | 137 | 141 | 137 | 141 |
| | | Polyethylene terephthalate | Melt viscosity 65 Pa · s (parts by mass) | — | — | — | — | — | — |
| | | | Melt viscosity 145 Pa · s (parts by mass) | 95 | 95 | 70 | 70 | 70 | 70 |
| | | | Melt viscosity 280 Pa · s (parts by mass) | — | — | — | — | — | — |
| | | | Melt viscosity 450 Pa · s (parts by mass) | — | — | — | — | — | — |
| | | Polybutylene terephthalate | Melt viscosity 118 Pa · s (parts by mass) | 5 | — | 30 | — | 30 | — |
| | | Polytrimethylene terephthalate | Melt viscosity 132 Pa · s (parts by mass) | — | 5 | — | 30 | — | 30 |
| | Bromine-containing flame retardant (B) (parts by mass) | Poly(pentabromobenzyl acrylate) | | 20 | 20 | 20 | 20 | — | — |
| | | Brominated phenol resin | | — | — | — | — | — | — |
| | | Polydibromophenylene oxide | | — | — | — | — | 20 | 20 |
| | Bromine-containing flame retardant (C) (parts by mass) | Brominated polystyrene | | — | — | — | — | — | — |
| | | Ethylene bistetrabromophthalimide | | — | — | — | — | — | — |
| | | Bis(pentabromophenyl)ethane | | — | — | — | — | — | — |
| | | Brominated epoxy resin | | — | — | — | — | — | — |
| | | Brominated phenoxy resin | | — | — | — | — | — | — |
| | Flame retardant auxiliary agent (D) (parts by mass) | Antimony trioxide | Average particle diameter 0.8 μm | — | — | — | — | — | — |
| | | | Average particle diameter 1.2 μm | — | — | — | — | — | — |
| | | | Average particle diameter 3.0 μm | — | — | — | — | — | — |
| | | Sodium antimonic acid | Average particle diameter 2.0 μm | — | — | — | — | — | — |

TABLE 4-continued

| | | Example 19 | Example 20 | Example 21 | Example 22 | Example 23 | Example 24 |
|---|---|---|---|---|---|---|---|
| Evaluation | Flame retardancy | ○ | ○ | ○ | ○ | ○ | ○ |
| | Transparency | ◎ | ◎ | ◎ | ◎ | ◎ | ◎ |
| | Texture | ○ | ○ | ◎ | ◎ | ◎ | ◎ |
| | Combability | ○ | ○ | ○ | ○ | ○ | ○ |
| | Sheen | ○ | ○ | ○ | ○ | ○ | ○ |

Evaluation methods and criteria for each evaluation item of Tables 1-4 are described below.

<Flame Retardancy>

Flame retardancy was evaluated by bundling 300 mm lengths of the fibrous molded body of the resin composition for artificial hair of the examples and the comparative examples into bundles having a weight of 2 g, fixing one edge of the fiber bundle and suspending vertically, contacting the bottom edge thereof with a 20 mm-long flame for five seconds, and then measuring the fire spread time after release and evaluating using the following evaluation criteria. The results used the average value of results measured ten times.

◎: Fire spread time of less than one second

○: Fire spread time of one second or more but less than seven seconds

X: Fire spread time of seven seconds or more

<Transparency>

Transparency was evaluated by bundling 250 mm lengths of the fibrous molded body of the resin composition for artificial hair into bundles having a weight of 20 g and having an artificial hair fiber processing technician (having at least five years' work experience) perform a comparative evaluation visually against human hair, using the following evaluation criteria.

◎: Has a transparency similar to or basically close to that of human hair.

○: Comparing closely, is found to be slightly cloudier than human hair, but basically has a transparency that could withstand a use as a fiber for artificial hair.

X: At first glance, is obviously cloudy and differences with human hair are found <Texture>

Texture was evaluated by bundling 250 mm lengths of the fibrous molded body of the resin composition for artificial hair into bundles having a weight of 20 g and having ten artificial hair fiber processing technicians (having at least five years' work experience) judge by touch, using the following evaluation criteria.

◎: Evaluated by at least nine technicians as being a good texture

○: Evaluated by seven or eight technicians as being a good texture

X: Evaluated by six or fewer technicians as being a good texture

<Combability>

Combability was evaluated by bundling 300 mm lengths of the fibrous molded body of the resin composition for artificial hair into bundles having a weight of 2 g and evaluating resistance and tangling of the fibers when a comb was passed through said fiber bundle.

◎: No resistance and fibers do not tangle

○: There is a little resistance but fibers do not tangle

X: There is resistance or fibers tangle

<Sheen>

Sheen was evaluated by bundling 250 mm lengths of the fibrous molded body of the resin composition for artificial hair into bundles having a weight of 20 g and having an artificial hair fiber processing technician (having at least five years' work experience) observe under natural light to perform a comparative evaluation visually against human hair, using the following evaluation criteria.

◎: Has similar sheen as human hair

○: Differences are found compared to human hair, but basically has a sheen that is close to human hair.

As disclosed in the above examples and comparative examples, it was discovered that by using a resin composition for flame retardant artificial hair, said composition being characterized by comprising: 100 parts by mass of a polyester (A) that comprises at least one kind of polyalkylene terephthalate or a copolymerized polyester having a polyalkylene terephthalate as a main constituent; and 5-40 parts by mass of a bromine-containing flame retardant (B) comprising at least one kind selected from poly(pentabromobenzyl acrylate), a brominated phenol resin, and polydibromophenylene oxide and in that the melt viscosity of the polyester (A) is 80-300 Pa·s, a fibrous molded body comprising a resin composition for artificial hair that exhibits excellent flame retardancy, transparency, and combability is obtained.

Moreover, it was discovered that by blending a 0.1-15 parts by mass of a bromine-containing flame retardant (C) selected from brominated polystyrene, ethylene bis-tetrabromophthalimide, bis(pentabromophenyl)ethane, a brominated epoxy resin, and a brominated phenoxy resin, it is possible to make the sheen more closely resemble that of human hair.

Moreover, it was discovered that by making the polyester (A) a resin in which polyethylene terephthalate and polybutylene terephthalate or polytrimethylene terephthalate are mixed, it is possible to make the texture more closely resemble that of human hair.

INDUSTRIAL APPLICABILITY

By using the resin composition for artificial hair of the present invention, it is possible to obtain an artificial hair product, or the like, that has favorable transparency and combability resembling those of human hair and exhibits excellent flame retardancy.

The invention claimed is:

1. A resin composition for flame retardant artificial hair, wherein said composition comprises 100 parts by mass of a polyester (A) and 5-40 parts by mass of at least one kind of bromine-containing flame retardant (B) selected from poly (pentabromobenzyl acrylate) and polydibromophenylene oxide and the melt viscosity of the polyester (A) is 80-300 Pa·s, wherein the polyester (A) comprises polyethylene terephthalate and polybutylene terephthalate, and the mass ratio of the polyethylene terephthalate to the polybutylene terephthalate is 40/60-98/2.

2. The resin composition for flame retardant artificial hair according to claim 1, further containing 0.1-15 parts by mass of at least one kind of bromine-containing flame retardant (C) selected from brominated polystyrene, ethylene bis-tetrabromophthalimide, bis(pentabromophenyl)ethane, a brominated epoxy resin and a brominated phenoxy resin.

3. The resin composition for flame retardant artificial hair according to claim 1, further containing a flame retardant auxiliary agent (D) having an average particle diameter of 0.5-1.5 μm.

4. A fibrous molded body comprising the resin composition for flame retardant artificial hair according to claim 1.

5. A wig comprising the fibrous molded body according to claim 4.

6. A ceresin composition for flame retardant artificial hair, wherein said composition comprises 100 parts by mass of a polyester (A) and 5-40 parts by mass of polydibromophenylene oxide as a bromine-containing flame retardant (B), and the melt viscosity of the polyester (A) is 80-300 Pa·s, wherein the polyester (A) comprises polyethylene terephthalate and polytrimethylene terephthalate, and the mass ratio of the polyethylene terephthalate to the polytrimethylene terephthalate is 40/60-98/2.

* * * * *